US010000708B2

(12) United States Patent
Van Willigenburg et al.

(10) Patent No.: US 10,000,708 B2
(45) Date of Patent: Jun. 19, 2018

(54) METHOD FOR HEATING CRUDE

(71) Applicants: Saudi Basic Industries Corporation, Riyadh (SA); SABIC Global Technologies B.V., PX Bergen Op Zoom (NL)

(72) Inventors: Joris Van Willigenburg, Geleen (NL); Arno Johannes Maria Oprins, Geleen (NL)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days. days.

(21) Appl. No.: 15/120,880

(22) PCT Filed: Dec. 23, 2014

(86) PCT No.: PCT/EP2014/079160
§ 371 (c)(1),
(2) Date: Aug. 23, 2016

(87) PCT Pub. No.: WO2015/128034
PCT Pub. Date: Sep. 3, 2015

(65) Prior Publication Data

US 2017/0009145 A1 Jan. 12, 2017

(30) Foreign Application Priority Data

Feb. 25, 2014 (EP) ..... 14156626

(51) Int. Cl.

| | |
|---|---|
| ***C10G 9/36*** | (2006.01) |
| ***C10G 55/08*** | (2006.01) |
| ***C10G 7/00*** | (2006.01) |
| ***C10G 7/12*** | (2006.01) |
| ***F28D 21/00*** | (2006.01) |

(52) U.S. Cl.
CPC ..... *C10G 9/36* (2013.01); *C10G 7/00* (2013.01); *C10G 7/12* (2013.01); *C10G 55/08* (2013.01); *F28D 21/0001* (2013.01); *C10G 2300/1033* (2013.01); *C10G 2300/4006* (2013.01); *F28D 2021/0059* (2013.01); *F28D 2021/0075* (2013.01)

(58) Field of Classification Search
CPC ..... C10G 9/36; C10G 2300/4006
See application file for complete search history.

(56) References Cited

U.S. PATENT DOCUMENTS

| | | | | |
|---|---|---|---|---|
| 1,923,271 | A * | 8/1933 | Lowe | C10G 9/14 196/106 |
| 2,294,126 | A | 8/1942 | Ocon | |
| 4,127,389 | A | 11/1978 | Hackemesser et al. | |
| 4,321,130 | A * | 3/1982 | Bacsik | C10G 9/14 208/106 |
| 4,827,072 | A | 5/1989 | Imai et al. | |
| 4,926,005 | A | 5/1990 | Olbrich et al. | |
| 7,622,623 | B2 | 11/2009 | Fridman et al. | |
| 2010/0025221 | A1 | 2/2010 | Agrawal et al. | |
| 2012/0024749 | A1 | 2/2012 | Strack et al. | |
| 2012/0298552 | A1 | 11/2012 | Koseoglu | |

FOREIGN PATENT DOCUMENTS

| | | |
|---|---|---|
| CN | 103210060 | 7/2013 |
| EP | 0192059 A1 | 8/1986 |
| EP | 0205205 A1 | 12/1986 |
| GB | 2162082 A | 1/1986 |

OTHER PUBLICATIONS

International Search Report and Written Opinion of corresponding International Application No. PCT/EP/2014/079160, dated Apr. 20, 2015; 10 pages.

* cited by examiner

*Primary Examiner* — Randy Boyer
(74) *Attorney, Agent, or Firm* — Norton Rose Fulbright US LLP

(57) ABSTRACT

A method for heating one or more streams from a refinery process, chosen from the group of a crude tower inlet, vacuum tower inlet, catalytic reformer inlet, coker inlet, thermal cracker inlet and hydrocracker inlet. The method includes transferring, in a heat exchanger, heat from one or more streams from a petro-chemistry process, chosen from the group of a steam cracker charge gas, propane dehydrogenation charge gas and butane dehydrogenation charge gas to said one or more streams from a refinery process for obtaining one or more heated streams in which the temperature of said one or more streams from petro-chemistry process is above the temperature of said one or more streams from a refinery process before said step of heat exchanging has taken place.

17 Claims, 3 Drawing Sheets

METHOD FOR HEATING CRUDE

This application is a § 371 of International Application No. PCT/EP2014/079160 filed Dec. 23, 2014, and claims priority from European Patent Application No. 14156626.5 filed Feb. 25, 2014.

TECHNICAL FIELD AND BACKGROUND OF THE INVENTION

The present invention relates to a method for heating one or more streams from a refinery process. More in detail, the present invention relates to the heat integration between petroleum refinery processes and petro-chemistry processes.

US patent application No 20120/24749 relates to method for cracking a hydrocarbon feed, the method comprising: providing a hydrocarbon feed to a hydrocarbon pyrolysis unit to create cracked effluent; passing at least a portion of the cracked effluent from the hydrocarbon pyrolysis unit through a first heat exchanger; separating the at least a portion of the cracked effluent from the first heat exchanger into a gaseous effluent and a liquid effluent; passing at least a portion of the gaseous effluent through a second heat exchanger; passing at least a portion of the effluent from the second heat exchanger to a fractionator; recovering heat from the at least a portion of the effluent in the second heat exchanger by passing a utility fluid through the second heat exchanger; and recovering heat from the at least a portion of the cracked effluent in the first heat exchanger by passing the utility fluid from the second heat exchanger through the first heat exchanger. This document teaches to use the heat from a stream from a petro-chemistry process for heating another stream, i.e. the utility fluid.

EP 0 205 205 relates to a transfer-line exchanger and a method for cooling of a fluid such as a cracked reaction product, the transfer-line exchanger of is a shell and tube type heat exchanger having two or more separate heat exchanging sections but only one inlet and one collection header, the separate sections being joined by intermediate tubes. in the cooling of a cracked hydrocarbon product having a temperature from 750° to 900° C., in the first heat exchanging zone, high pressure steam can be produced using water at its boiling temperature and pressure as the cooling fluid in that zone. Alternatively, in the second heat exchanging zone, the partially cooled, cracked reaction product, having a temperature from 450° to 650° C. can be further cooled to produce lower pressure steam. This document teaches to cool a cracked reaction product by using a transfer-line exchanger of the shell and tube type.

U.S. Pat. No. 2,294,126 relates to process for distilling and fractionating crude petroleum oil in heat exchange with heat treated hydrocarbon products undergoing fractionation, which comprises contacting the hot products produced by cracking a hydrocarbon distillate to lower boiling hydrocarbons with a catalytic adsorbent to complete the cracking reaction and to precipitate tars and fuel oil higher boiling than gas oil, passing the remaining hot products in the vapor phase without substantial condensation into contact with the hot products obtained by a non-carbonizing splitting treatment of a reduced crude to strip volatiles therefrom. This document teaches the unification of the heated product separation with the preparation of charging stocks in order to eliminate heat dissipating vessels, such as partly detached towers, and the multiple connections, found in the usual vast array of apparatus used in cracking systems.

Petroleum refining processes are the chemical engineering processes and other facilities used in petroleum refineries (also referred to as oil refineries) to transform crude oil into useful products such as liquefied petroleum gas (LPG), gasoline or petrol, kerosene, jet fuel, diesel oil and fuel oils. Petrochemicals are chemical products derived from petroleum and examples thereof are olefins (including ethylene, propylene, and butadiene) and aromatics (including benzene, toluene and xylene isomers). Oil refineries produce olefins and aromatics by fluid catalytic cracking of petroleum fractions. Chemical plants produce olefins for example by steam cracking of natural gas liquids like ethane and propane. Aromatics are for example produced by catalytic reforming of naphtha.

Nowadays, industrial plants where petroleum refinery processes, e.g. a steam cracker unit, are carried out are separated from industrial plants where petrochemical processes, e.g. a crude distillation unit (CDU), are carried out. Such a separation means in fact that no heat integration takes place between these processes, i.e. petroleum refinery processes and petrochemical processes.

The crude furnace of a crude distillation unit heats up oil to temperatures of approximately 350° C. Heat is normally provided by the combustion of gas or oil. A crude-oil atmospheric-distillation (or topping) plant makes it possible to obtain distillates (made up of the overhead product and the side fractions) and the residue, by the physical separation of a mixture of homologous components. This separation, which makes use of the differing distributions of the components between the vapor and the liquid phases, takes place in stages operating in conditions close to equilibrium. The separation of the various fractions of the distillate is achieved by fractional condensation of the vapors of the distillate, which is an operation requiring heat removal. In the case of a distillation column (or still) this heat removal is carried out by means of a series of refluxes: external reflux, consisting of part of the condensed overhead product, and intermediate refluxes, consisting of liquid withdrawn from the column and, after cooling, returned to it at a point above that from which it was withdrawn. Intermediate refluxes are commonly called circulating refluxes or pump around. The feed, coming from the storage tanks, is pumped to the heater, having been preheated with heat recovered, by means of a heat exchanger, from the overhead vapors, side fractions, intermediate refluxes and the atmospheric residue. After having been heated in the heater to the temperature required for the operating conditions, the feed is transferred to the flash zone of the atmospheric column by means of a transfer line, where the separation takes place into the vaporized fractions (equivalent to the total of the distillates) and the liquid residue.

In a steam cracker furnace a hydrocarbon feed is heated to temperatures above 800° C. and then rapidly cooled (quenched indirectly) to at least below 600° C., generating very high pressure steam. The gas is further cooled by high pressure steam generation and other forms of heat recovery and eventually by water quench, air coolers, and water coolers.

Steam cracking is an energy intensive process. Very high temperature heat is required for the steam cracking process. Lower temperature heat is or can be recovered from the process. However, the separation process requires mainly cold and little need for (low exergy) heat in the temperature range of 200-400° C., this applies especially for steam crackers with light feed stocks.

In addition, refining of crude oil requires heat in the temperature range of 200-400° C.: crude oil is heated to approximately 350° C. in the crude furnace before entering the atmospheric tower. In the crude furnace oil or gas (high exergy) is fired to provide heating at relatively (low exergy) mild temperatures (compared to steam cracking). Such a crude furnace may have good energy efficiency but is rather poor on the exergy efficiency.

BRIEF SUMMARY OF THE INVENTION

An object of the present invention is to provide a method for the integration of heat of petroleum refinery processes, e.g. a steam cracker unit, with petrochemical processes, e.g. a crude distillation unit (CDU).

An object of the present invention is thus linking streams from heat producing units on the chemical side with heat demanding refinery streams.

Another object of the present invention is to provide a method for saving energy on petroleum refinery processes.

Another object of the present invention is to provide a method for heating crude wherein all or part of the duty of the crude furnace can be replaced.

The present invention thus relates to a method for heating one or more streams from a refinery process, chosen from the group of crude tower inlet, vacuum tower inlet, catalytic reformer inlet, coker inlet, thermal cracker inlet and hydrocracker inlet, said method comprising a step of transferring, in a heat exchanger, heat from one or more streams from petro-chemistry process, chosen from the group of steam cracker charge gas, propane dehydrogenation charge gas and butane dehydrogenation charge gas, to one or more streams from a refinery process for obtaining one or more heated streams, wherein the temperature of one or more streams from petro-chemistry process is above the temperature of one or more streams from a refinery process before said step of heat exchanging has taken place.

The term "charge gas" herein refers to a gas stream coming from a specific process unit, i.e. an outlet gas stream having a high temperature, i.e. effluent stream or products stream. For example, the term "steam cracker charge gas" refers to a gas stream coming from a steam cracker furnace. The terms "propane dehydrogenation charge gas" and "butane dehydrogenation charge gas" refer to a gas stream coming from a propane dehydrogenation furnace and a gas stream coming from a butane dehydrogenation furnace, respectively. Such a gas stream may comprise a plurality of chemical components.

The above paragraph refers to "a heat exchanger" which means that such a heat exchanger may comprise one or more heat exchanging units. These units may be run in parallel, in series, or in a combination thereof. The present invention is not restricted to a specific number of heat exchanging units or to its way of operation, i.e. parallel, in series, or in a combination thereof.

The present invention thus provides a method wherein a heat exchanger is used to transfer heat from petroleum refinery processes, e.g. a crude distillation unit (CDU), a vacuum distillation unit (VDU), hydrocracker, coker, catalytic cracker, to petrochemical processes, e.g. a steam cracker unit, a dehydrogenation unit, to replace all or part of the duty of the furnaces. The present inventors assume that such a method has beneficial effects, such as longer furnace run length and lower capital costs. Please note the present invention does not relate to the integration of process streams between petroleum refinery units and petrochemical units but to the integration of heat.

According to a preferred embodiment of the present method crude tower inlet is heated by transferring, in a heat exchanger, heat from steam cracker charge gas to the crude tower inlet for obtaining a heated crude tower inlet.

In an embodiment wherein the transfer of heat does not directly result in the desired final temperature, an additional heating step is required. Such a step comprises a step of additionally heating the crude tower inlet in a crude furnace, wherein the step of additionally heating takes place after transferring heat from steam cracker charge gas. According to another embodiment the step of heating further comprises a step of additionally heating the crude tower inlet in a crude furnace, wherein the step of additionally heating takes place before transferring heat from steam cracker charge gas.

In an embodiment wherein the heat capacity of the stream of the petroleum refinery processes is high enough, not only that heat can be transferred to the crude tower inlet but to other streams from petrochemical processes as well. An example thereof is wherein the vacuum tower inlet is heated by transferring, in a heat exchanger, heat from the steam cracker charge gas to the vacuum tower inlet for obtaining a heated vacuum tower inlet stream.

It is preferred that the temperature at the inlet of said heat exchanger, i.e. the temperature of one or more streams from petro-chemistry process, is at least 10° C., preferably at least 50° C., higher than the temperature at the outlet of said heat exchanger, i.e. the temperature of one or more streams from a refinery process.

For an efficient transfer of heat between the one or more streams from a refinery process and heat from one or more streams from petro-chemistry process it is preferred that the temperature of the at least one or more streams from petro-chemistry process is in the range of 350-600 degree Celsius.

In the present method examples of refinery heat consuming units are (maximum temperature requirements in parenthesis): crude tower (380° C.), vacuum tower (420° C.), catalytic reformer (550° C.), coker (460° C.), thermal cracking (540° C.) and hydrocracker (430° C.).

In the present method examples of petro-chemistry heat producing units are (average temperature in parenthesis): steam cracker furnace after primary TLE (600° C.) and reactor effluent from propane-butane dehydrogenation unit (PDH/BDH) (600° C.).

A very common process for the conversion of alkanes to olefins involves "steam cracking" As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is very high, at around 850° C., but the reaction is only allowed to take place very briefly, usually with residence times of 50-500 milliseconds. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butanes or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases (CO2 and H2S) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for converting alkanes to olefins.

The term "propane dehydrogenation unit" as used herein relates to a petrochemical process unit wherein a propane feedstream is converted into a product comprising propylene and hydrogen. Accordingly, the term "butane dehydrogenation unit" relates to a process unit for converting a butane feedstream into C4 olefins. Together, processes for the dehydrogenation of lower alkanes such as propane and butanes are described as lower alkane dehydrogenation process. Processes for the dehydrogenation of lower alkanes are well-known in the art and include oxidative hydrogenation processes and non-oxidative dehydrogenation processes. In an oxidative dehydrogenation process, the process heat is provided by partial oxidation of the lower alkane(s) in the feed. In a non-oxidative dehydrogenation process, which is preferred in the context of the present invention, the process heat for the endothermic dehydrogenation reaction is provided by external heat sources such as hot flue gases obtained by burning of fuel gas or steam. For instance, the UOP Oleflex process allows for the dehydrogenation of propane to form propylene and of (iso)butane to form (iso)butylene (or mixtures thereof) in the presence of a catalyst containing platinum supported on alumina in a moving bed reactor; see e.g. U.S. Pat. No. 4,827,072. The Uhde STAR process allows for the dehydrogenation of propane to form propylene or of butane to form butylene in the presence of a promoted platinum catalyst supported on a zinc-alumina spinel; see e.g. U.S. Pat. No. 4,926,005. The STAR process has been recently improved by applying the principle of oxydehydrogenation. In a secondary adiabatic zone in the reactor part of the hydrogen from the intermediate product is selectively converted with added oxygen to form water. This shifts the thermodynamic equilibrium to higher conversion and achieve higher yield. Also the external heat required for the endothermic dehydrogenation reaction is partly supplied by the exothermic hydrogen conversion. The Lummus Catofin process employs a number of fixed bed reactors operating on a cyclical basis. The catalyst is activated alumina impregnated with 18-20 wt-% chromium; see e.g. EP 0 192 059 A1 and GB 2 162 082 A. The Catofin process is reported to be robust and capable of handling impurities which would poison a platinum catalyst. The products produced by a butane dehydrogenation process depends on the nature of the butane feed and the butane dehydrogenation process used. Also the Catofin process allows for the dehydrogenation of butane to form butylene; see e.g. U.S. Pat. No. 7,622,623.

BRIEF DESCRIPTION OF THE DRAWINGS

The invention will be described in further detail below and in conjunction with the attached drawings in which the same or similar elements are referred to by the same number, and where.

DETAILED DESCRIPTION OF THE INVENTION

Figure 1:
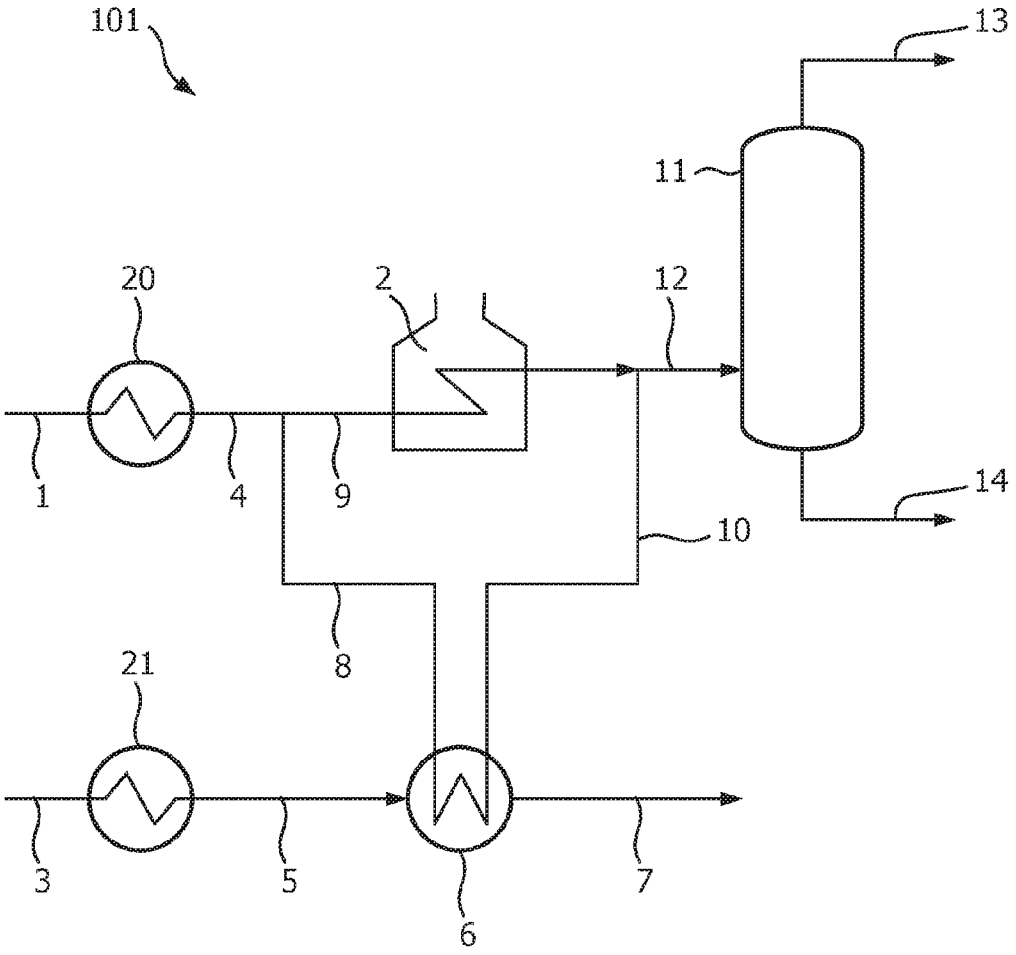
FIG. 1 is a schematic illustration of an embodiment of the process of the invention.

Referring now to the process and the apparatus schematically depicted in FIG. 1, there is shown a method 101 for heating crude. Crude 1 is preheated in a crude preheater 20 and the thus preheated crude 4 can be sent directly, via line 9, to a crude furnace 2. The heated crude 12 having a temperature of around 350° C. is sent to a unit 11. This route is the standard route for heating crude to a final temperature. Unit 11 relates to a refinery unit, such as for example a CDU, VDU, HYC, Coker or FCC, wherein stream 1 can be identified as a heat demanding refinery stream, i.e. a stream that needs to be raised in temperature before sending to unit 11. Although the following discussion of the embodiments identifies unit 11 as an atmospheric tower, the present invention is not restricted to such a refinery unit.

According to the present method shown in FIG. 1 cracked gas 3 coming from a cracking furnace and having a temperature of around 800° C., is sent to a heat exchanger (TLE) 21 providing an effluent 5 having a temperature of around 500-400° C. The pre-heated crude 4 is brought, via line 8, into contact with the effluent 5 in a heat exchanger 6 resulting in a heated crude 10. The crude 10 thus heated is sent to atmospheric tower 11. Cracked gas 7 coming from heat exchanger 6 has now a temperature in the range of 150-250° C. According to this method heat from a petrochemistry process, i.e. the cracked gas from a steam cracking furnace 3 is integrated in a stream from a refinery process, i.e. an atmospheric tower 11.

Figure 2:
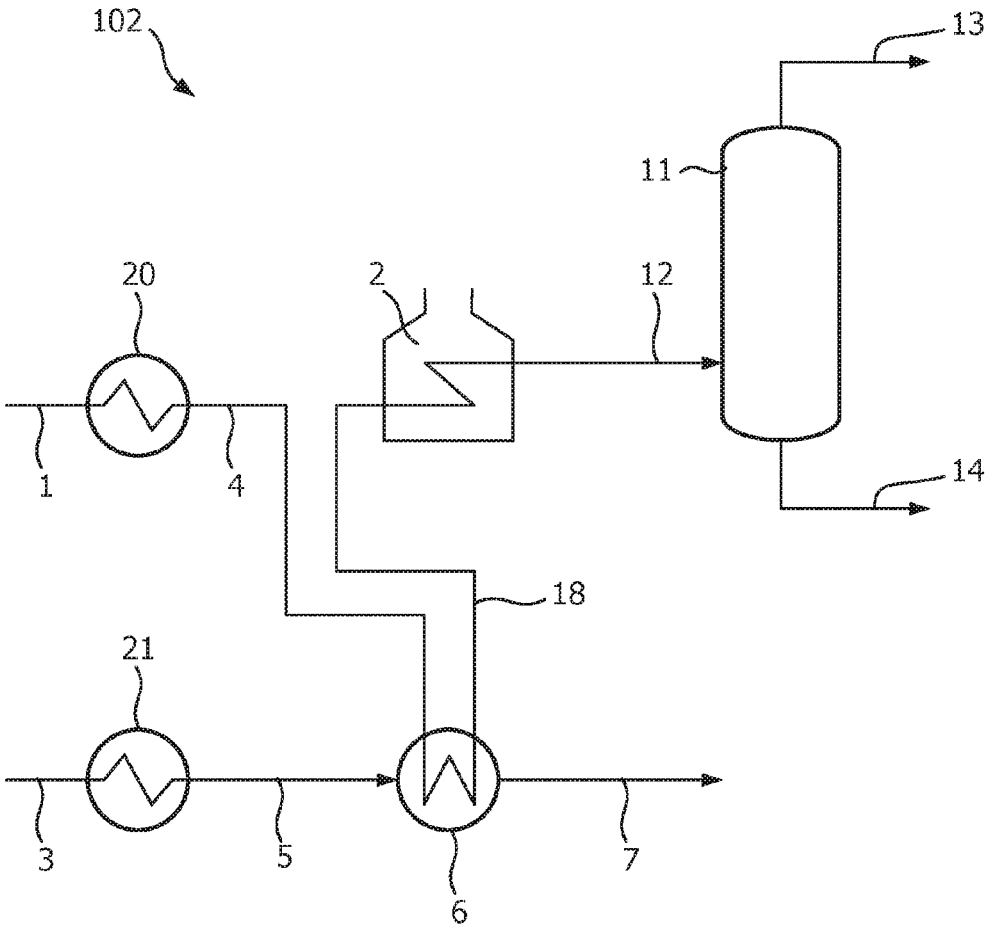
FIG. 2 is another embodiment of the process of the invention.

FIG. 2 shows another embodiment of the process 102 for heating crude, wherein cracked gas 3 from a cracking furnace having a temperature of around 800° C. is sent to a heat exchanger (TLE) 21 resulting in an effluent 5 having a temperature of around 400-500° C. Crude 1 is sent to a crude preheater 20 and its effluent 4 is brought into contact with the effluent 5 in a heat exchanger 6 resulting in heated crude 18. If necessary, crude 18 can be further heated in a crude furnace 2 resulting in a crude 12 having a final temperature of around 350° C. In this embodiment crude 12 is sent to an atmospheric tower 11. According to another embodiment (not shown) it is also possible to send effluent 4 first to a crude furnace 2 and then the crude thus heated to a heat exchanger 6 for further transferring heat between the heated crude and effluent 5. In the last embodiment the step of additionally heating in the furnace 2 takes place before transferring heat from steam cracker charge gas 3.

Figure 3:
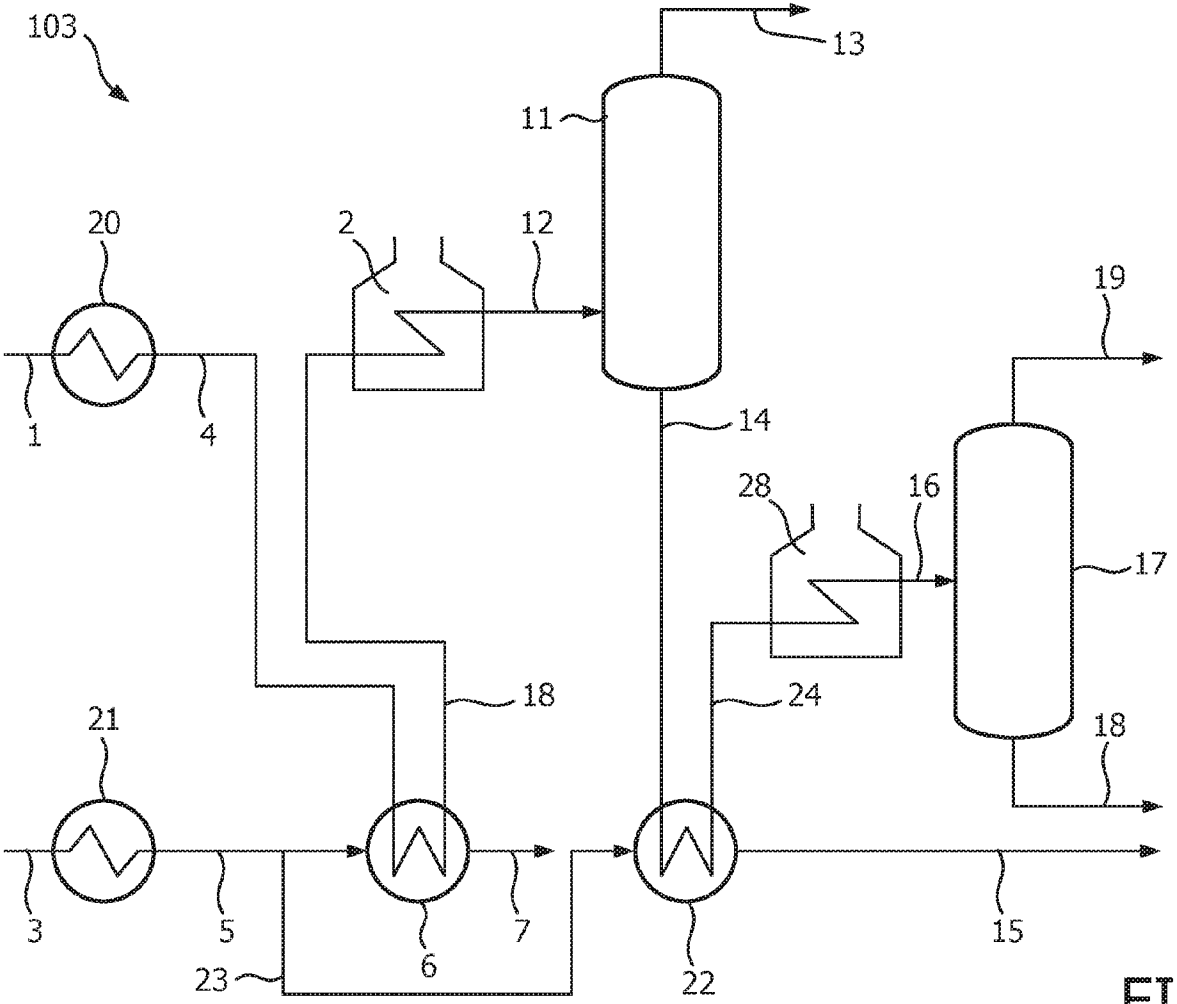
FIG. 3 is another embodiment of the process of the invention.

FIG. 3 shows another embodiment of the process 103 for heating crude, wherein the heat capacity of stream 5 is also used to heat bottom stream 14 of atmospheric tower 11. Thus, bottom stream 14 can be further heated by a heat changer 22 to the desired inlet temperature of a feed 16 to a vacuum distillation tower 17. In vacuum distillation tower 17 feed 16 is separated into a top stream 19 and a bottom stream 18. The outlet stream of heat exchanger 22 can be mixed with the outlet stream 7 of heat exchanger 6 resulting in a mixed stream to be used for further possible heat integration purposes. Although FIG. 3 shows two different heat exchangers 6, 22, these two heat exchangers are integrated into one single heat exchanger according to a preferred embodiment. According to another embodiment heat exchangers 6, 22 can be run in parallel, in series, or in a combination thereof.

As shown above, heat exchanger 6 is used to transfer heat from cracked gas 3 to an already preheated crude oil to replace all or part of the duty of the crude furnace 2. As shown in FIG. 2, an exergy advantage can be achieved by preheating crude in a convection section of a crude preheater 20 and subsequently heating crude 4 in heat exchanger 6 to the desired final temperature. FIG. 3 shows a preferred embodiment of further linking streams from heat producing units on the chemical side with heat demanding refinery streams.

EXAMPLES

The examples refer to the application of crude heating by integration with ethylene furnace.

The relevant data are: Cracking Furnace Ethane Feed: 100 t/h, Cracking Furnace steam to oil ratio: 0.33, and Cracking Furnace effluent temperature: 850° C., Crude feed to crude furnace: 230 t/h, Crude feed temperature 150° C. and Crude final temperature: 350° C.

According to the state of the art processes there is no heat exchange between the processes for heating crude and cooling cracked gas (see scheme 1).

Scheme 1

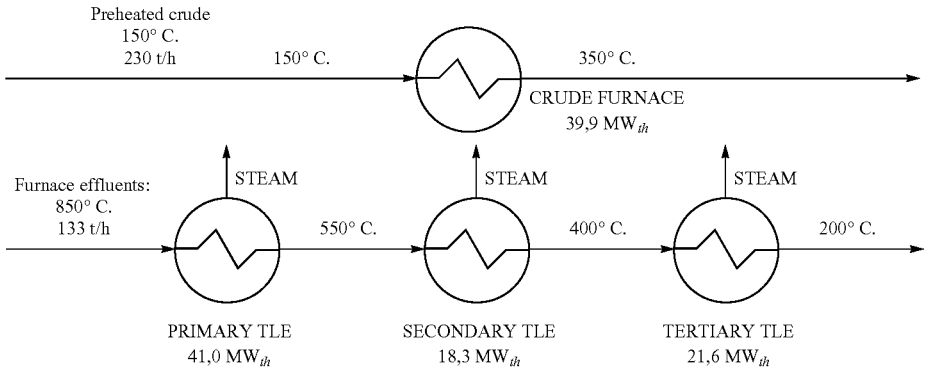

An example of heat integration using the present invention, is provided by the scheme 2.

Scheme 2

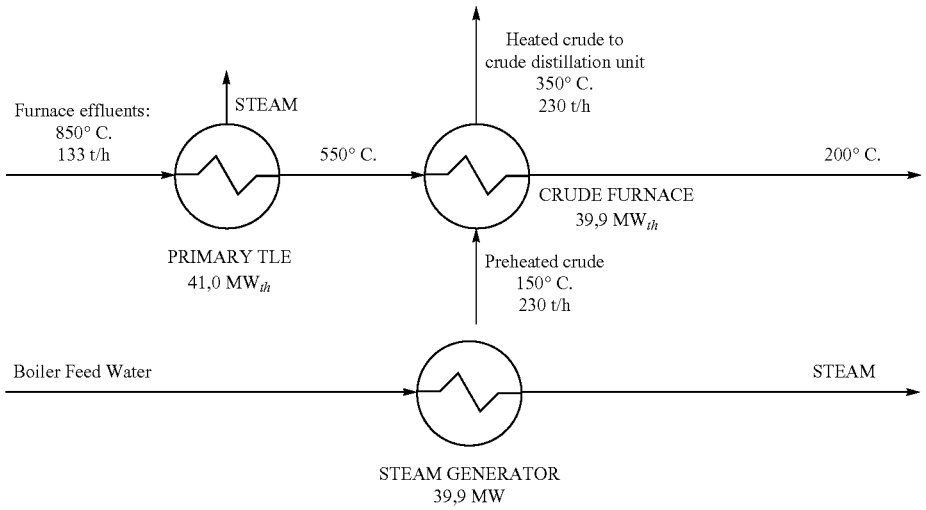

The example above shows that the heat recovery from the secondary and tertiary TLE could be replaced by the heat recovery from a crude heater, heating and partly evaporating 230 t/h crude from 150 to 350° C. This avoids the requirements for a crude furnace. However the steam generated by the secondary and tertiary TLE's will have to be generated by other means, such as conventional steam boilers. Although this example refers to the use of TLE's, other hot streams can be used here as well, for example hot streams originating from dehydrogenation units, such as a propane dehydrogenation unit and butanes dehydrogenation unit.

Stand alone steam generation is more efficient than stand alone crude preheating, resulting in energy savings: where the typical thermal efficiency of a crude furnace is 85%, the typical efficiency of a steam boiler is 90%, the resulting energy savings are 39.9/85%-39.9/90%=2.6 MW of fuel gas.

Energy savings can be further increased by applying combined heat and power technologies such as back pressure steam turbines and gas turbines with waste heat boilers.

The invention claimed is:

1. A method for heating one or more streams from a refinery process, chosen from a crude tower inlet, a vacuum tower inlet, a catalytic reformer inlet, a coker inlet, a thermal cracker inlet and a hydrocracker inlet, said method comprising a step of transferring, in a heat exchanger, heat from one or more streams from a petro-chemistry process, chosen from a steam cracker charge gas, a propane dehydrogenation charge gas and a butane dehydrogenation charge gas to said one or more streams from a refinery process for obtaining one or more heated streams, wherein the temperature of said one or more streams from the petro-chemistry process is above the temperature of said one or more streams from a refinery process before said step of heat exchanging has taken place, wherein the crude tower inlet is heated by transferring, in a heat exchanger, heat from the steam cracker charge gas to said crude tower inlet for obtaining a heated crude tower inlet.

2. The method according to claim 1, wherein said step of heating further comprises a step of additionally heating said crude tower inlet in a crude furnace, wherein said step of additionally heating takes place after transferring heat from steam cracker charge gas.

3. The method according to claim 1, wherein said step of heating further comprises a step of additionally heating said crude tower inlet in a crude furnace, wherein said step of additionally heating takes place before transferring heat from steam cracker charge gas.

4. The method according to claim 1, wherein the vacuum tower inlet is heated by transferring, in a heat exchanger, heat from said steam cracker charge gas to said vacuum tower inlet for obtaining a heated vacuum tower inlet stream.

5. The method according to claim 1, wherein the temperature at an inlet of said heat exchanger is at least 10° C. higher than the temperature at an outlet of said heat exchanger.

6. The method according to claim 1, wherein temperature of said at least one or more streams from the petro-chemistry process is in the range of from 350° C. to 600° C.

7. The method according to claim 1, wherein said step of heating further comprises a step of additionally heating said crude tower inlet in a crude furnace.

8. The method according to claim 2, wherein the temperature at an inlet of said heat exchanger is at least 10° C. higher than the temperature at an outlet of said heat exchanger.

9. The method according to claim 3, wherein the temperature at an inlet of said heat exchanger is at least 10° C. higher than the temperature at an outlet of said heat exchanger.

10. The method according to claim 4, wherein the temperature at an inlet of said heat exchanger is at least 10° C. higher than the temperature at an outlet of said heat exchanger.

11. The method according to claim 6, wherein the temperature at an inlet of said heat exchanger is at least 10° C. higher than the temperature at an outlet of said heat exchanger.

12. The method according to claim 2, wherein temperature of said at least one or more streams from the petro-chemistry process is in the ranges range of from 350° C. to 600° C.

13. The method according to claim 3, wherein temperature of said at least one or more streams from the petro-chemistry process is in the ranges range of from 350° C. to 600° C.

14. The method according to claim 4, wherein temperature of said at least one or more streams from the petro-chemistry process is in the ranges range of from 350° C. to 600° C.

15. The method according to claim 4, wherein said step of heating further comprises a step of additionally heating said crude tower inlet in a crude furnace.

16. The method according to claim 5, wherein said step of heating further comprises a step of additionally heating said crude tower inlet in a crude furnace.

17. The method according to claim 6, wherein said step of heating further comprises a step of additionally heating said crude tower inlet in a crude furnace.

* * * * *